United States Patent [19]

Shiomura

[11] Patent Number: 4,785,558

[45] Date of Patent: Nov. 22, 1988

[54] SHOE UPPER OF INTERKNITTED OUTER AND INNER KNIT LAYERS

[75] Inventor: Kazuhiko Shiomura, Osaka, Japan

[73] Assignee: Toray Industries, Inc., Tokyo, Japan

[21] Appl. No.: 76,443

[22] Filed: Jul. 22, 1987

[30] Foreign Application Priority Data

Jul. 31, 1986 [JP] Japan ..... 61-118269[U]

[51] Int. Cl.[4] ..... A43B 5/00; A43B 23/00

[52] U.S. Cl. ..... 36/114; 36/3 A; 36/45; 66/196; 66/202

[58] Field of Search ..... 36/114, 45, 47, 48, 36/3 A, 9 R, 43; 66/196, 202, 87

[56] References Cited

U.S. PATENT DOCUMENTS

| | | | |
|---|---|---|---|
| 625,331 | 5/1899 | Heaton | 36/3 R |
| 3,864,944 | 2/1975 | Jackson | 66/196 X |
| 4,232,458 | 11/1980 | Bartels | 36/45 |
| 4,430,811 | 2/1984 | Okada | 36/45 |

FOREIGN PATENT DOCUMENTS

| | | | |
|---|---|---|---|
| 2459851 | 1/1981 | France | 66/196 |
| 55-110501 | 8/1980 | Japan | 36/45 |
| 7713557 | 8/1979 | Sweden | 36/43 |
| 649612 | 3/1979 | U.S.S.R. | 66/196 |
| 391101 | 7/1931 | United Kingdom | 36/9 R |
| 437390 | 10/1935 | United Kingdom | 36/3 A |

*Primary Examiner*—James Kee Chi

*Attorney, Agent, or Firm*—Armstrong, Nikaido, Marmelstein & Kubovcik

[57] ABSTRACT

A shoe is described having a shoe upper comprising an outer knit fabric layer, an inner knit fabric layer provided opposite to said outer knit fabric layer through a space, and a crossing thread which is interknitted to be bound into the outer and inner knit fabric layers and crosses the space.

7 Claims, 2 Drawing Sheets

SHOE UPPER OF INTERKNITTED OUTER AND INNER KNIT LAYERS

BACKGROUND OF THE INVENTION

This invention relates to a shoe. More particularly, the present invention is concerned with an athletic shoe suitable for use primarily in marathon, jogging, tennis, volleyball and like sports.

In general, a fabric is commonly used as a shoe upper of an athletic shoe. It is said that proper elasticity inherent in the shoe upper made of a fabric is advantageous in that it does not give a sense of oppression and a sense of fatigue. With respect to the shoe upper made of a fabric having such elasticity, U.S. Pat. Nos. 3,793,750 and 4,043,058 each propose a shoe upper having a multilayer sandwich construction prepared by interposing a plastic foam layer, such as a polyurethane layer, between an outer fabric layer and an inner fabric layer and bonding them.

However, the above-mentioned shoe upper having a plastic foam layer interposed therein is not necessarily satisfactory in air permeability. Therefore, this causes problems such that the inside of the shoe becomes stuffy and hot because of abnormal temperature increase attributable to the sweating and generation of heat from feet during exercise, which brings about a discomfort. Further, although the above-mentioned resin foam layer has elasticity, it is large in resistance to the movement between the outer and inner fabric layers, because it is bonded to each of the outer and inner fabric layers with an adhesive, which leads to a large resistance of the shoe upper per se to bending. This inhibited the effect of alleviating a sense of oppression and a sense of fatigue for the feet.

SUMMARY OF THE INVENTION

An object of the present invention is to provide a shoe, particularly an athletic shoe, of which the shoe upper has a combination of suitable elasticity with high air permeability.

Another object of the present invention is to provide a shoe, particularly an athletic shoe, of which the shoe upper is not coarse to the touch and, therefore, enhances the effect of alleviating a sense of oppression and a sense of fatigue.

In order to attain the above objects, the shoe of the present invention has a shoe upper comprising an outer knit fabric layer, an inner knit fabric layer provided parallel to the outer knit fabric layer through a space, and a crossing thread which is inserted so as to cross the space and is interknitted to be bound into the outer and inner knit fabric layers.

Since the shoe upper having the above construction uses a knit fabric layer as the base, it is remarkably superior in flexibility to a shoe upper which uses a fabric as the base. Further, this shoe upper has a space between the inner and outer knit fabric layers into which a crossing thread is inserted and, therefore, can exhibit not only air permeability much higher than that of a conventional shoe upper having a resin foam layer interposed therein but also suitable elasticity. Moreover, in this shoe upper, the crossing thread is interknitted in a dot form to be bound into the inner and outer knit fabric layers rather than a face-to-face bonding with an adhesive adopted in the conventional resin foam layer, which enables a interlaminar movement and causes no significant resistance to bending and pressing. Therefore, this shoe upper is not coarse to the touch and is advantageous in enhancing the effect of alleviating a sense of oppression and a sense of fatigue.

DESCRIPTION OF THE PREFERRED EMBODIMENTS

Figure 1:
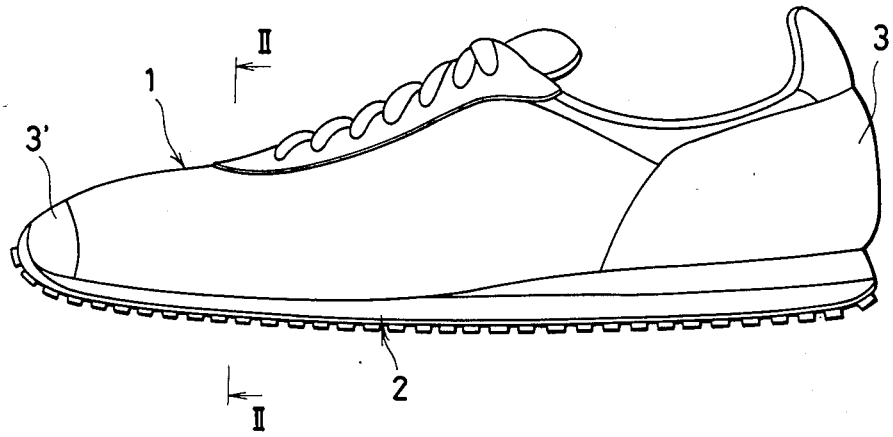
FIG. 1 is a side elevational view of one form of the athletic shoe of the present invention.
Figure 2:
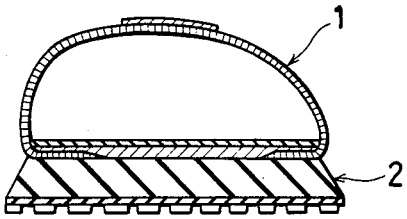
FIG. 2 is a cross-sectional view taken along the line II—II of FIG. 1.

As shown in FIGS. 1 and 2, the athletic shoe of the present invention comprises a shoe upper 1 and a rubber sole 2 attached to the shoe upper 1. If necessary, the surface of the shoe upper 1 may be provided at its heel and toe portions with wear-resistant leather materials 3, 3'.

Figure 3:
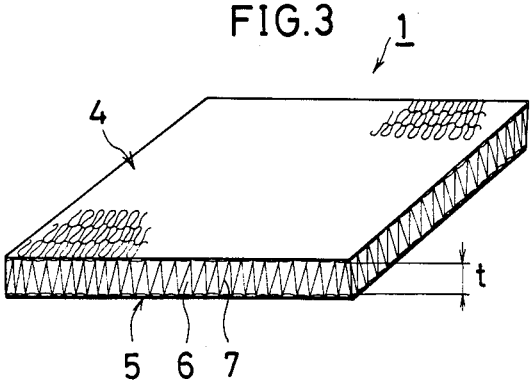
FIG. 3 is a perspective view of a shoe upper used in the athletic shoe as shown in FIG. 1.
Figure 4:
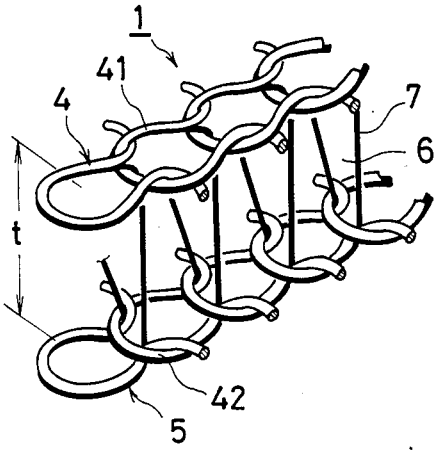
FIG. 4 is an enlarged perspective view showing the principal part of the shoe upper as shown in FIG. 3.

As shown in FIGS. 3 and 4, the shoe upper 1 comprises an outer knit fabric layer 4, an inner knit fabric layer 5 provided parallel to the outer knit fabric layer 4 through a space 6, and a number of crossing threads 7 which cross the space 6. The outer knit fabric layer 4 is knitted from a yarn 41 while the inner knit fabric layer 5 is knitted from a yarn 42. The crossing threads 7 are interknitted to be bound into the outer and inner knit fabric layers 4, 5.

In the shoe upper comprising such a three-dimensional structure, the outer and inner knit fabric layers are not necessarily required to be the same and may be different from each other in texture and density. With respect to the stitch density, it is preferred that the stitch density of the outer knit fabric layer be larger than that of the inner knit fabric layer. The knitting texture is not limited to a plain texture and may be a texture having a pattern.

Although the yarns 41, 42 used for the outer and inner knit fabric layers may be any of synthetic fibers such as polyester and nylon and natural fibers such as cotton and hemp and are not particularly limited, the yarn 41 of the outer knit fabric layer is preferably a filament yarn or a spun yarn made of a synthetic fiber having excellent wear resistance while the yarn 42 of the inner knit fabric layer is preferably a spun yarn made of a natural fiber having excellent moisture absorptivity.

It is preferred that a yarn having a high bending stiffness be used as the crossing thread 7 which is interknitted to be bound into both the outer and inner knit fabric layers 4, 5 and crosses the space 6. The use of such a yarn imparts higher elasticity to the shoe upper 1. In order to further enhance such an elastic effect, it is preferred that a synthetic monofilament or multifilament having a single yarn fineness of 3 to 50 denier be used as the crossing thread. A synthetic monofilament is particularly preferable because it exhibits higher bending stiffness.

The space in which the crossing thread is present exhibits air permeability higher than that of the conventional resin foam layer. In order to further enhance the air permeability, it is preferred that the crossing threads be arranged at a density of 500 to 4500 threads/inch$^2$ and at intervals, t, of about 1 to 10 mm.

The above-mentioned shoe upper can be easily knitted using a knitting machine such as a tricot knitting machine or a Raschel knitting machine. The knitting may be stepwise conducted through a step of knitting the outer and inner knit fabric layers and a step of connecting the outer and inner knit fabric layers with the crossing threads. Alternatively, the knitting may be conducted using a double Raschel knitting machine which can knit the shoe upper simply in one step because it can simultaneously conduct the two above-mentioned steps. Therefore, the latter method is advantageously adopted.

Figure 5:
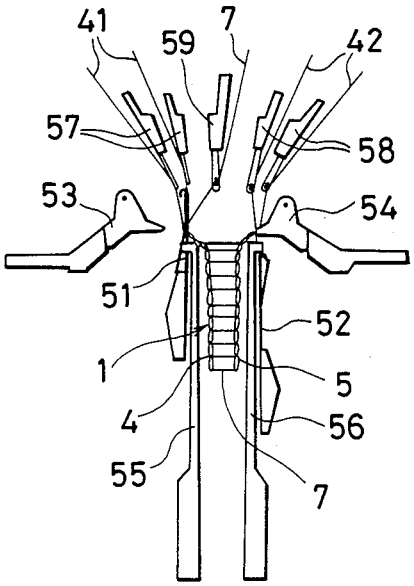
FIG. 5 is a transverse sectional view showing one form of a double Raschel knitting machine used for knitting the shoe upper as shown in FIG. 3.

FIG. 5 illustrates an example of the knitting of the shoe upper with a double Raschel knitting machine.

In FIG. 5, numerals 51 and 52 designate two sets of needles which are alternately lifted. One or a plurality of guide bars 57, 58 (two guide bars for each set of needles in this example) are arranged above each set of needles. The yarns 41, 42 which have been carried by the guide bars 57, 58 are knitted into stitches through an up-and-down motion. The two sets of needles 51, 52 each constitute a needle row in a direction perpendicular to the space. One needle row comprised of the needles 51 knits the outer knit fabric layer 4 from the yarn 41 while the other needle row comprised of the needles 52 knits the inner knit fabric layer 5 from the yarn 42. The needles 51, 52 are respectively provided with stitch combs 53, 54 which move to the left and the right. The stitch combs 53, 54 serve to prevent the rise of the outer and inner knit fabric layers 4, 5 which occurs when the needles 51, 52 are lifted. Further, trick plates 55, 56 are provided under the stitch combs 53, 54 in a direction parallel to the motion of the needles in order to hold the outer and inner knit fabric layers 4, 5. Further, another one or plurality of guide bars 59 (one guide bar in this example) are provided between the guide bars 57, 58. The guide bar 59 feeds the crossing thread 7 by turns to the two sets of needles 51, 52 which are alternately lifted, and overlaps with the lifting needle to knit the yarn into the outer and inner knit fabric layers 4, 5 by turns, thereby knitting the shoe upper 1 in only one step.

Since the shoe upper thus knitted is formed of knit fabric layer as the base, it can exhibit excellent flexibility inherent in the knit fabric layer. Further, the above shoe upper has a space interposed between the outer and inner knit fabric layers and a crossing thread inserted in the space. Therefore, it can exhibit not only air permeability much higher than that of the conventional shoe upper having a resin foam layer interposed therein but also suitable elasticity by virtue of the crossing thread. Moreover, in the above shoe upper, the crossing thread is interknitted in a dot form to be bound into the inner and outer knit fabric layers, which does not inhibit an interlaminar movement unlike the conventional resin foam layer which has been bonded in a face-to-face form and, therefore, causes no significant resistance to bending and pressing. Therefore, the shoe upper according to the present invention is not coarse to the touch and exhibits an excellent effect of further alleviating a sense of oppression and a sense of fatigue.

I claim:

1. A shoe comprising a sole and a shoe upper attached to said sole, wherein said shoe upper is comprised of an outer knit fabric layer, an inner knit fabric layer provided opposite to said outer knit fabric layer through a space having a thickness of 1 to 10 mm, and a crossing thread which is interknitted to be bound into said outer and inner knit fabric layers and crosses said space, said crossing thread being provided at a density of 500 to 4500 threads per square inch and having a single yarn fineness of 3 to 50 denier.

2. A shoe according to claim 1, which is an athletic shoe.

3. A shoe according to claim 1, wherein said crossing thread is comprised of a synthetic monofilament.

4. A shoe according to claim 1, wherein said crossing thread is comprised of a synthetic multifilament.

5. A shoe according to claim 1, wherein said outer knit fabric layer is constituted of a synthetic fiber yarn and said inner knit fabric layer is constituted of a cotton yarn.

6. A shoe according to claim 1, wherein said outer knit fabric layer has a stitch density higher than that of said inner knit fabric layer.

7. A shoe according to claim 1, wherein said shoe upper is knitted with a double Raschel knitting machine.

* * * * *

US004785558B1

REEXAMINATION CERTIFICATE (3498th)

United States Patent [19] [11] B1 4,785,558

Shiomura [45] Certificate Issued Apr. 21, 1998

[54] SHOE UPPER OF INTERKNITTED OUTER AND INNER KNIT LAYERS

[75] Inventor: Kazuhiko Shiomura, Osaka, Japan

[73] Assignee: Toray Industries, Inc., Tokyo, Japan

Reexamination Request:
No. 90/004,167, Mar. 5, 1996

Reexamination Certificate for:

| | |
|---|---|
| Patent No.: | **4,785,558** |
| Issued: | **Nov. 22, 1988** |
| Appl. No.: | **76,443** |
| Filed: | **Jul. 22, 1987** |

[30] Foreign Application Priority Data

Jul. 31, 1986 [JP] Japan ..... 61-118269 U

[51] Int. Cl.[6] ..... A43B 5/00; A43B 23/00

[52] U.S. Cl. ..... 36/114; 36/3 A; 36/45; 66/196; 66/202

[58] Field of Search ..... 36/45, 114, 47, 36/48, 3 A, 9 R, 43; 66/196, 202, 87

[56] References Cited

U.S. PATENT DOCUMENTS

| | | | |
|---|---|---|---|
| 2,067,739 | 1/1937 | Tanski | 66/196 |
| 4,280,342 | 7/1981 | Eng et al. | 66/177 |
| 4,430,811 | 2/1984 | Okada | 36/45 |
| 4,601,940 | 7/1986 | Fischer | 428/178 |

FOREIGN PATENT DOCUMENTS

| | | |
|---|---|---|
| 52-32440 | 3/1977 | Japan . |
| 59-109792 | 7/1984 | Japan . |
| 60-98407 | 7/1985 | Japan . |
| 7713557 | 8/1979 | Sweden . |

OTHER PUBLICATIONS

"High Quality Textile Floor Coverings from a Raschelmachine HDR 5 DPLH," Kettenwirk-praxis, Apr. '70, Obertshausen, pp. 19–20.

D.F. Paling, "Warp Knitting Technology," Columbine Press, Buxton, U.K. (1970), pp. v, 1, 194, 195, 212–215, 230 and 231.

*Primary Examiner*—Marie Denise Patterson

[57] ABSTRACT

A shoe is described having a shoe upper comprising an outer knit fabric layer, an inner knit fabric layer provided opposite to said outer knit fabric layer through a space, and a crossing thread which is interknitted to be bound into the outer and inner knit fabric layers and crosses the space.

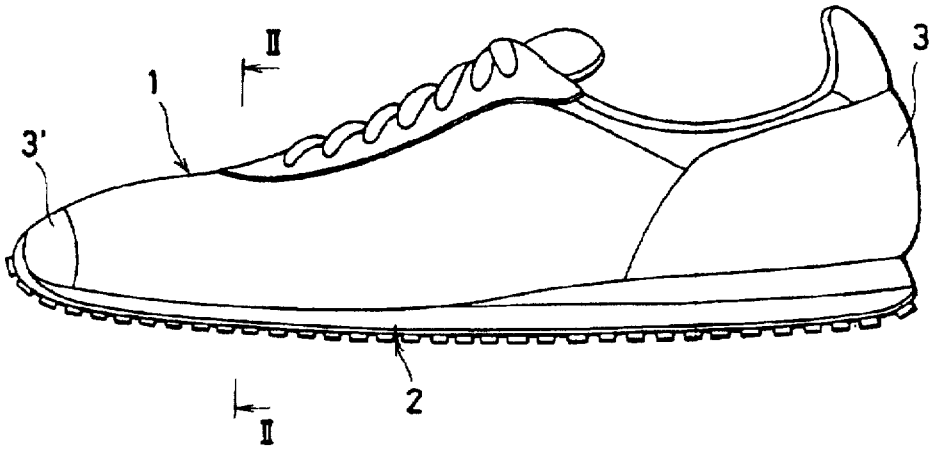

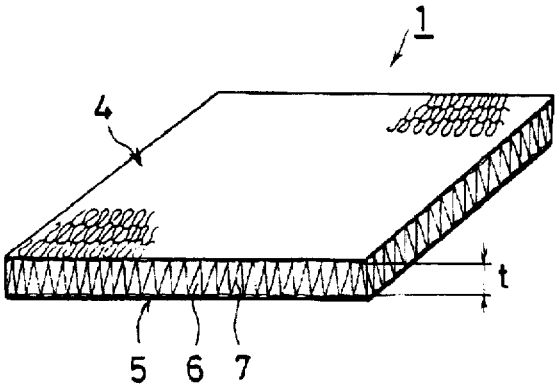

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–7 are cancelled.

* * * * *